US005483274A

United States Patent [19]

Inoue et al.

[11] Patent Number: 5,483,274

[45] Date of Patent: Jan. 9, 1996

[54] THERMAL HEAD AND THERMAL TRANSFER APPARATUS

[75] Inventors: Nobuhiro Inoue; Akira Nakano; Yukio Tsuda; Katsunari Sasaki, all of Tokyo; Toshiro Nose, Sagamihara; Masayoshi Aihara, Tokyo, all of Japan

[73] Assignee: Kabushiki Kaisha Toshiba, Kawasaki, Japan

[21] Appl. No.: 13,167

[22] Filed: Feb. 2, 1993

Related U.S. Application Data

[63] Continuation of Ser. No. 616,245, Nov. 20, 1990, abandoned.

[30] Foreign Application Priority Data

| | | | |
|---|---|---|---|
| Nov. 24, 1989 | [JP] | Japan | 1-303067 |
| Nov. 24, 1989 | [JP] | Japan | 1-303068 |
| Mar. 19, 1990 | [JP] | Japan | 2-66957 |

[51] Int. Cl.[6] ..... B41J 2/335

[52] U.S. Cl. ..... 347/206

[58] Field of Search ..... 346/76 PH; 347/206, 347/200, 201

[56] References Cited

U.S. PATENT DOCUMENTS 3,903,393 9/1975 Stapleton et al. ..... 346/76 PH 4,698,643 10/1987 Nishiguchi et al. ..... 346/76 PH

FOREIGN PATENT DOCUMENTS 330439 8/1989 European Pat. Off. .

OTHER PUBLICATIONS

Patent Abstracts of Japan: vol. 7, No. 291 (M–265) (1436), Tokyo Shibaura Denki, K.K. (1983).

Patent Abstracts of Japan: vol. 12, No. 131 (M–688) (2978), Matsushita Electric Ind. Co., Ltd. (1988).

*Primary Examiner*—Huan H. Tran

*Attorney, Agent, or Firm*—Finnegan, Henderson, Farabow, Garrett & Dunner

[57] ABSTRACT

A thermal head is used on a thermal transfer recording apparatus which can record a continuous, fine line or curve by recording many dots, by a thermal transfer system, on a recording sheet. The thermal head comprises a one-dimensional array of heat generation element groups each comprised of a plurality of heat generation elements, such as heat generation resistors of, for example, a parallelogram, a diamond or an elliptic configuration, continuously arranged in a direction perpendicular to that in which recording is made on a recording sheet and lead electrodes connected adjacent to each other in predetermined positions, in which the longitudinal sides of the heat generation resistors are made oblique at a predetermined angle.

4 Claims, 8 Drawing Sheets

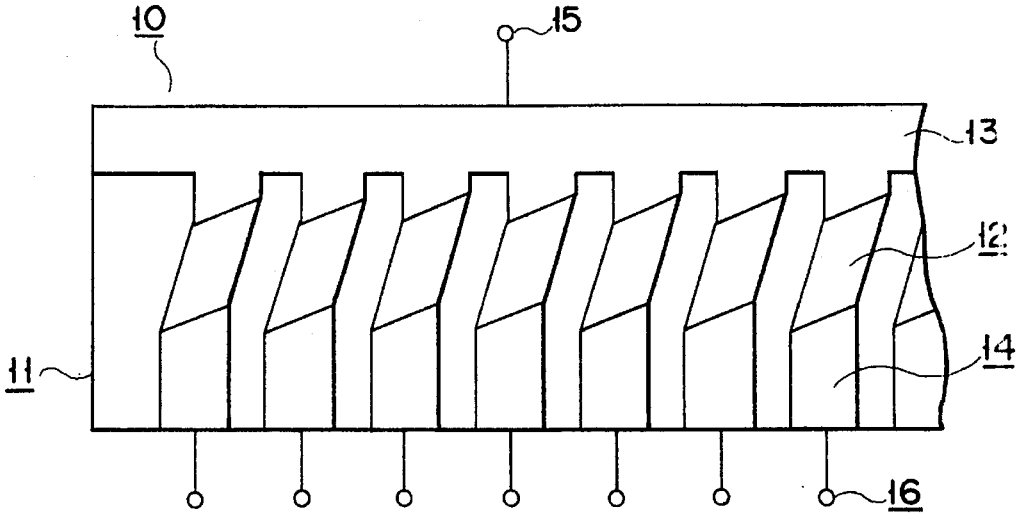
F I G. 3A
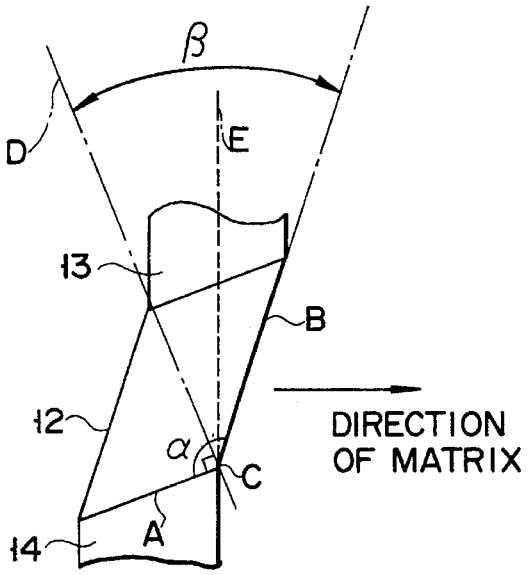
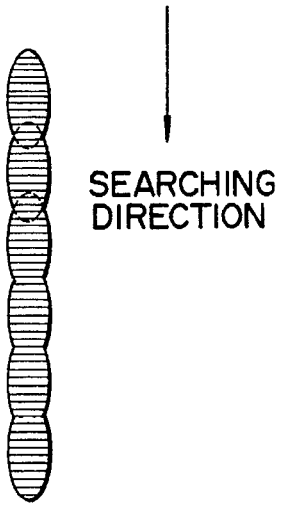
F I G. 3B
F I G. 3C

THERMAL HEAD AND THERMAL TRANSFER APPARATUS

This application is a continuation, of application Ser. No. 07/616,245 filed Nov. 20, 1990, now abandoned.

BACKGROUND OF THE INVENTION

1. Field of the Invention

The present invention relates to a line type thermal head applied to, for example, a thermal printer, which is comprised of a one-dimensional array of heat generation resistors, and to a thermal transfer recording apparatus equipped with such a thermal head.

2. Description of the Related Art

FIG. 6A shows one form of a conventional thermal head. A thermal head 1 comprises a plurality of heat generation resistors 51 of a parallelogrammic configuration formed on an insulating substrate 50, such as ceramics or alumina, and arranged at a predetermined interval in a linear array, a pair of lead electrodes 52, 53 formed on both ends of the resistor 51, and external terminals 54 and 55 connected to the lead electrodes 52 and 53. The opposite sides of the lead electrodes 52 and 53 are defined along the array of the resistors 51 and the lead electrode 52 is continuous to provide a common electrode.

In the thermal head as set out above, the size of a recording dot can be varied by varying an amount of energy to be applied to the resistor 51. This is because the resistors, constituting the thermal head, is parallelogrammic in configuration and allow an energy concentration to occur due to an energy distribution one-sided in the resistors 51. It is thus possible to better record a medium-tone image on a recording sheet.

The basic technique of the thermal head will be explained below in more detail.

When a voltage is applied across the lead electrodes 52 and 53 in the thermal head as set out above, a flow field in the heat generation resistors 51 is as shown in FIG. 7. In FIG. 7, black points represent points of measurement where the sense of their line shows a sense of current at the point of measurement and the length of the line shows a magnitude of current at the point of measurement.

FIG. 7 shows a view for explaining how the current distribution in the resistors is as shown n FIG. 7. Let it now be assumed that the values of the resistors 51 do not vary by their heat generation. The heat generation resistors are each formed of, for example, a thin film, though having somewhat a very small thickness, and can be regarded as being a two-dimensional plane in which case the thickness of the resistor is disregarded. Based on the aforementioned assumption, the current distribution in the resistors 51 becomes a stationary electric current field. Since no magnetic density B (Bx, By) varies in the stationary electric current field, the following equation holds with the use of the "Maxwell equation"

$$rotE = -\frac{\partial B}{\partial t} = 0 \quad (1)$$

Further, a current density i (ix, iy) establishes the following equation with the use of the Law of Conservation of Electric Charge $$divi=0 \quad (2)$$

with a conductivity δ and electric field E (Ex, Ey), $$i=\delta E \quad (3)$$

with the use of the Ohm's law.

Substituting Equation (3) into Equation (2) yields $$divE=0 \quad (4)$$

From Equations (1) and (2) the following equation holds in the presence of a scalar function V:

$$E=-grad\ V \quad (5),$$

noting that Vin Equation (5) stands for a potential.

Substituting Equation (5) into (4) gives a Laplace's differential equation below:

$$\frac{\partial^2 V}{\partial x^2} + \frac{\partial^2 V}{\partial y^2} = 0 \quad (6)$$

Also, the energy density en can be expressed as follows:

$$en=iE=\delta E^2 \quad (7)$$

Solving Equation (6), as well as Equation (5) for the electric field E, gives a distribution of heat energy from Equation (7).

Equation (6) is numerically analyzed using a "boundary element method". Here the boundary element method comprises dividing a boundary of a closed system into a plurality of elements, as shown in FIG. 8, and finding a solution for every element with the use of predetermined boundary conditions. By so doing, it is possible to find the inner state of the closed system.

In this way, it is possible to obtain a flow field as shown in FIG. 7.

As appreciated from Equation (7), electric current shows a greater value as it goes toward the middle of the heat generation resistor 51. Further, a quantity of heat generated at any given point in the resistor 51 is expressed by a product of a squared quantity of electric current at that location and a resistive value of the resistor 51, that is, is proportional to a square of the electric current. Thus the quantity of heat generation is great at the middle of the resistor 51.

On the other hand, more quantity than a predetermined quantity of generation heat is required for dot recording. If a smaller voltage is applied to the resistor 51, dots are recorded over a heat generation range as indicated by 61*a* in FIG. 7. With an increasing application voltage, dots are recorded over a heat generation range as indicated by 61*b*, 61*c* in FIG. 7.

A substantially heat generation area can be varied as indicated, for example, by 61*a*, 61*b* and 61*c* by applying a varying amount of energy to the resistor 51. It is thus possible to modulate a dot size.

On the other hand, since an electric current distribution in the resistor 51 varies depending upon the size of the resistor 51, the resistor may assume a specific shape for the most suitable half-tone printing, a shape which generates a concentrated heat to an extent exceeding a certain level. Here, for a parallelogram having typical values, a ratio g between a length La of one side 51*a* and a length Lb of a side 51*b* intersecting with the side La and an angle θ (here an acute angle) made between these sides 51*a* and 51*b* as shown in FIG. 9 are given below, as an optimal shape, (1) the ratio of (b/a)≦1

(2) the angle θ≦45°

The above matter has already been proposed by the present applicant under Japanese Patent Application 1-195686 (1989).

The optimal shape of the resistor 51 so set will be briefly explained below. Here a thermal head as applied to a G3 facsimile will be explained below by way of example.

In the G3 facsimile equipment, since an image resolution in a horizontal scanning direction (a direction of the resistor array) is defined as 8 [dots/mm], the width, that is, the length La of the resistor 51 is given by $$La \leqq 125\ \mu m$$

with a resistor-to-resistor gap given by 25 μm and the resistor 51 set as large as possible, $$La = 100\ \mu m$$

Here consideration is paid to combinations of the angle and ratio g as given below.

(1) a ratio [1], [1.5], [2] at an angle θ of 30°

(2) a ratio [1], [1.5], [2] at an angle θ of 45°

(3) a ratio [1], [1.5], [2] at an angle θ of 60°

(4) a ratio [1], [1.5], [2] at an angle θ of 75°

For a plurality (here 12) of types of resistor shapes, a current distribution may be considered by the aforementioned method with the outline of the resistor as a boundary as shown in FIG. 7, provided that La=100 μm, a potential on the lead electrode 53=24 V, and a potential on the lead electrode 52=0 V.

Further, an electric field E in the horizontal scanning direction and diagonal direction (see FIG. 9) is evaluated and an energy density en calculated based on the electric field with the use of Equation (7) is divided by the conductivity δ, that is, en/δ. From this it follows that the smaller the angle θ and ratio g the greater the center concentration of the electric current.

Noting the ratio g it is found that, for g=[2], the energy distribution is substantially uniform and that there is almost no energy concentration. It is also found that a smaller energy concentration is developed at the ratio g=[1.5] and that a marked energy concentration occurs at the ratio [1.5]. Further, noting the angle θ at the ratio g=[1], an energy concentration is pronounced at the angle θ of below 45°.

From the above it may be inferred that the following equation is established for the optimal shape of the resistor 51.

(1) the ratio ≦1

(2) the angle θ≦45°

If a thermal head is to be constructed for application to the G3 facsimile equipment, the resistor 51 is made at a height of about 70 μm or below in views of its width=100 μm so as to obtain an optimal shape. Further, the resistor has an optimal size if the image resolution in a vertical scanning direction is above 15.4 [lines/mm], provided that the height is below 70 μm.

In a currently available ordinary facsimile equipment (G3), a resolution in a vertical scanning direction, such as 7.7 [lines/mm]relative to 8 [dots/mm], is lower than the aforementioned resolution 15.4 [lines/mm]. It has, therefore, been difficult to construct such an ordinary low-resolution thermal head.

FIGS. 6A and 6B show a conventional thermal head and dots recorded by the thermal head, respectively, the array of dots being shown in the vertical scanning direction, that is, in the feed direction of a recording sheet. As shown in FIG. 6B, the recording dots become, for example, elliptic in shape due to a concentrated energy in the resistors of the thermal head as set out above. The major axes of the elliptic recording dots are made oblique relative to the vertical scanning direction.

In the conventional thermal printer, a "separation" direction as will be set forth below is the same as the vertical scanning direction and dots are recorded in the elliptic state with their major axes oblique in the vertical scanning direction as shown in FIG. 6B. If any spacing is left between the respective adjacent recorded dots, however, ink transfer tends to be unstable at almost all edge portions of the dots due to the greater edge portion of respective dots present and the greater edge portion of the respective dots made oblique in the "separation" direction. This gives rise to a very poor quality image.

As set out above, the conventional thermal recording apparatus and hence the thermal head records dots as elliptic ones in which case their major axes are made oblique in the vertical scanning direction with a spacing left between the adjacent recorded dots. This causes a very unstable ink transfer upon the separation of an ink film from a recording paper and a greatly degraded image.

In recent times, a growing demand is made for a colored document to be transmitted as data by a facsimile equipment and a recording apparatus (color printer) for color recording has vigorously been developed in this field of art. In the conventional color printer, dots are recorded as colored dots of predetermined shape, though somewhat different for their shape and size depending upon the recording conditions. With attention paid to one pixel in a recording image, recording has to be made with a color dot almost completely superimposed on a previous color dot in the same position. If an almost complete superimposition is achieved between these color dots in the same position, a resultant color dot is sharply distinguishable from another color dot incompletely superimposed in a common dot position. As a result, a moire (interference fringe) is produced depending upon the types of image patterns. In the color recording in particular, an image quality is degraded due to the occurrence of the moiré.

SUMMARY OF THE INVENTION

It is accordingly a first object of the present invention to provide a thermal head which can make an image recording on a recording sheet even at a low image resolution level through the utilization of heat generation resistors of optimal configuration.

A second object of the present invention is to provide a thermal recording apparatus, such as a thermal printer, which can record a high-quality image on a recording sheet by stably transferring ink to the recording sheet upon the separation of an ink film from the recording sheet.

The other object of the present invention is to provide a thermal head for color recording which can obtain a high-quality image without producing a moiré on a recording image.

The thermal head according to the first embodiment of the present invention is so arranged that a plurality of heat generation resistors are arranged in a direction perpendicular to a pair of their opposite sides not connected to lead electrodes.

The thermal head according to the second embodiment of the present invention is so constructed that a plurality of heat generation resistors are arranged adjacent to each other in a mirror image relation in a direction perpendicular to a pair of their sides not connected to lead electrodes.

In the present embodiment, the thermal head has a plurality of heat generation resistors obliquely so arranged at a predetermined angle that, within an acute angle range defined between a perpendicular, on one hand, drawn from an apex of one of opposite obtuse angles of a parallelogram of the heat generation resistor toward the resistor's side connected to the lead electrode a and an adjacent one, on the other hand, of those opposite sides not connected to the lead electrode, a line passing through the aforementioned apex extends in a direction orthogonal to a direction in which the plurality of heat generation resistors are arranged.

In the first and second embodiments of the present invention, a pair of opposite sides of the respective resistor which are not connected to the lead electrodes are set in a direction perpendicular to a direction (a horizontal scanning direction) in which the resistors are arranged. As a result, the length of the resistor as defined in a direction (vertical scanning direction) perpendicular to the horizontal scanning direction, that is, the height of the resistor corresponds to the length of the pair of opposite sides of the resistor which are not connected to the lead electrodes, that is, is greater than the length (width) of the resistor as defined in the horizontal scanning direction.

Since the heat generation resistors are obliquely so arranged at a predetermined angle that, within an acute angle range defined between a perpendicular, on one hand, drawn from an apex of one of opposite obtuse angles of a parallelogram of the heat generation resistor toward the resistor's side connected to the lead electrodes and an adjacent one, on the other hand, of those opposite sides not connected to the lead electrodes, a line passing through the aforementioned apex extends in a direction orthogonal to a direction in which the plurality of heat generation resistors are arranged, that is, since the vertical scanning direction corresponds to a line passing through the aforementioned apex, that is, a line passing in an acute angle range defined between a perpendicular, on one hand, drawn from the apex of one of opposite sides of the parallelogram of the resistor toward the resistor's side connected to the lead electrodes and an adjacent one, on the other hand, of those opposite sides not connected to the lead electrodes, these features produce an advantage and function as will be set out below. Thus elongated dots are recorded on the recording sheet with their major axes oriented substantially in the vertical scanning direction.

The other embodiments of the present invention involve the following ingenious features (1) to (6).

(1) The thermal head is displaced in accordance with color to be recorded.

(2) The plurality of heat generation elements are so arranged that they correspond to one pixel. One of the plurality of heat generation elements is selectively used in accordance with color to be recorded.

(3) The plurality of thermal heads are arranged in a direction of conveyance of the recording sheet such that they are displaced a predetermined amount in a direction orthogonal to that in which the recording sheet is conveyed. One of the plurality of thermal heads is selectively employed in accordance with color to be recorded.

(4) The recording timing or conveyance of the recording sheet is varied by a predetermined extent in accordance with color to be recorded.

(5) The plurality of thermal heads for recording elongated dots with their major axes differently oriented in their individual directions are arranged in the direction of conveyance of the recording sheet and one of the plurality of thermal heads is selectively used in accordance with color to be recorded.

(6) The thermal head is so arranged that one of the plurality of heat generation elements for recording elongated dots on the recording sheet with their major axes differently oriented in their individual directions is selectively used in accordance with color to be recorded.

Through these ingenious features, at least one of dots of different color is displaced in its recording position relative to the other color dot as shown in FIG. 5B(*a*) or respective elongated color dots have their major axes differently oriented in their individual directions as shown in FIG. 5B(*b*). In this way, dots are recorded on the recording sheet with a non-overlapped portion or portions left there.

In the color recording, therefore, since at least one dot of a color is formed with a portion not partially overlapped with the other dot or dots of different color, a pixel area and non-pixel area are vaguely defined, making it possible to record dots on a recording sheet in a uniform color tone free of any interference fringe.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 3A to 3C are views for explaining a thermal head according to a third embodiment of the present invention, FIG. 3A being a plan view showing an arrangement of a thermal head, FIG. 3B being a plan view for explaining the shape of a heat generation resistor for the thermal head and FIG. 3C being a view showing one form of recording by the present thermal head with attention paid to a dot line formed in a vertical scanning direction;

FIGS. 6A to 9 are views for explaining a basic technique of respective thermal heads as will be set out below, FIG. 6A is a plan view showing a conventional thermal head;

FIG. 7 is a view showing a flow field in a heat generation resistor when voltage is applied to the thermal head;

FIG. 8 is a view showing a closed system for numeral analysis using a boundary element method; and FIG. 9 is a view for explaining a method for determining a parallelogram optimal for the most suitable half-tone printing.

DETAILED DESCRIPTION OF THE PREFERRED EMBODIMENTS

A thermal head according to a first embodiment of the present invention will be explained below with reference to the accompanying drawings.

Figure 1A:
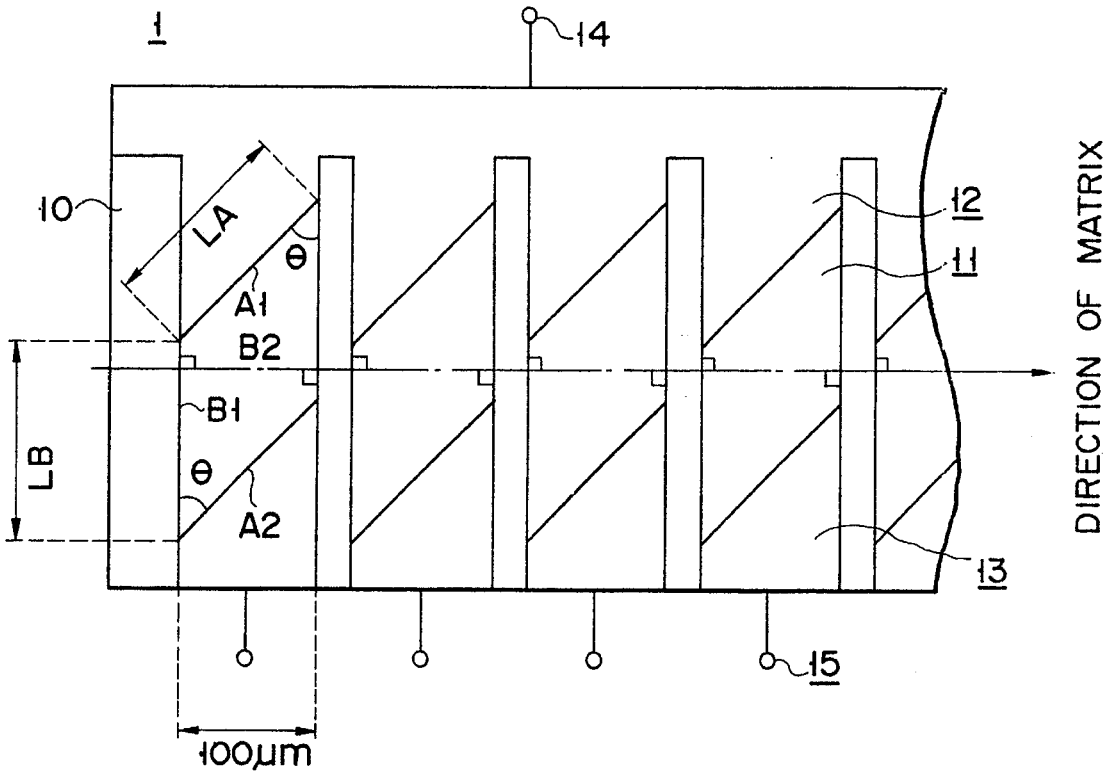
FIG. 1A is a plan view showing an arrangement of a thermal head according to a first embodiment of the present invention.

A thermal head as shown in a plan view in FIG. 1A is of such a type that a plurality of heat generation resistors 11 paralleogrammic in shape are one-dimensionally arranged at a predetermined interval over an insulating substrate 10, such as ceramics or alumina. Lead electrodes 12, 13 are overlappingly arranged relative to respective end portions of the heat generation resistors 11. A thermal head is fabricated as a finished product with external terminals 14 and 15 connected to the lead electrodes 12 and 13. In the present embodiment, the lead electrode 12 provides a common electrode.

The resistor 11 is so constructed that a pair of sides A1 and A2 connected to the lead electrodes 12 and 13 have a length LA equal to a length LB of a pair of sides B1, B2 of the resistor 11 which are not connected to the lead electrodes 12 and 13. The sides A1 and A2 make an angle θ of 45° with the sides B2 and B1 of the resistor 11. The resistors 11 are arranged in a direction perpendicular to their sides B1 and B2.

The present thermal head, if being designed for the G3 facsimile equipment, has a specification as will be set out below.

That is, the resolution is 8 [dots/mm] in the horizontal scanning direction and the resistor 11 has a width (a length in the horizontal scanning direction) of 100 μm. The shape of the resistor 11 has a length LA at their opposite sides A1 and A2 and a length LB at their other opposite sides B1 and B2 to provide a parallelogram with an acute angle θ of 45° made between the adjacent sides A1 and B2 and between the adjacent sides A2 and B1. From the following equation the lengths LA and LB are found to be about 141 μm.

$$LA = LB = 100 \times \sqrt{2} \ [\mu m]$$

In the present thermal head, the height (the horizontal scanning direction) of the resistor 11 is equal to the side LB of the resistor 11 because the sides B1 and B2 of the resistor 11 are so defined as to extend in a direction perpendicular to a direction, that is, the horizontal scanning direction, in which the resistors 11 are arranged. Therefore, it is possible to obtain a resolution of 8 [dots/mm]×7.7 (lines/mm) for which case the resistors 11 have a height of about 141 μm each and a pitch of about 130 μm as viewed in the horizontal scanning direction.

According to the present invention, since the resistors 11 are arranged in a direction perpendicular to the sides B1 and B2 not connected to the lead electrodes 12 and 13, they can ensure a greater height level than according to the conventional counterpart even if being optimally formed under the conditions (1) and (2) as will be set out below. It is thus possible to achieve a head suitable even for lower-resolution recording.

(1) A ratio of below 1 is set between the length LA of the opposite sides A1, A2 connected to the lead electrodes 12, 13 and the length LB of the other opposite sides B1, B2 of the resistor 11 which are not connected to the lead electrodes 12, 13.

(2) An acute angle θ is set in a range of below 45° made between the sides A1 and B2 and between the sides A2 and B1 of the resistor 11.

Figure 1B:
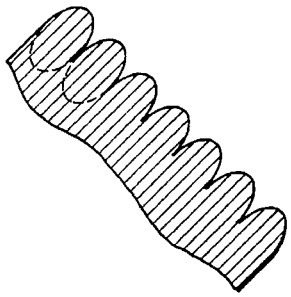
FIG. 1B is a view showing one from of recording pattern (diagonal line) as made by a thermal head of the first embodiment.

According to the thermal head thus constructed, dots are recorded as elliptic ones as set out above. The elliptic dots have their major axes made oblique in the horizontal and vertical scanning directions. With attention paid to diagnol-line elements of an image recorded by the thermal head, a continuous line appears as a jagged line with adjacent elliptic elements overlapped as shown in FIG. 1B.

FIG. C is a diagrammatic view showing a thermal transfer type recording apparatus, such as a thermal printer, using the aforementioned thermal head.

In FIG. 1, a thermal head 1 is of a line type having a plurality of heat generation resistors one-dimensionally arranged across a whole recording width. The head 1 is urged by a spring 2 against a platen roller 3. The platen roller 3 is rotationally driven by a rotational force of a pulse motor 4 through a belt 5. An ink film 6 and recording sheet 7 are fed past a nip between the thermal head 1 and the platen roller 3. That is, the ink film 6 is fed by an ink film conveying mechanism, not shown, and the recording paper 7 is fed by the rotation of the platen roller 3.

A printer controller 9 is connected to a computer, etc., and is responsive to printer control data supplied from the computer to control the aforementioned ink film mechanism, not shown, and pulse motor 4, that is, control the conveyance of the ink film 6 and recording sheet 7. The thermal head controller 8 is located in a image data processing section and receives image data and subjects it to a conversion processing. The resultant image data is fed to the thermal head 1. The image data processing section controls a drive electric power to the thermal head 1 on the basis of the image data, which is received from the thermal head control 8 and, and supplies an electric power to the thermal head 1. Each time a printing is completed on one line, the thermal head controller 8 transmits a notice to that effect to the printer controller 9. Then the printer controller 9 sends a control signal for conveying the ink film 6 and recording sheet 7 by an amount corresponding to one line to the pulse motor 4 and, after the pulse motor has been rapidly rotated by one line, locates a subsequent unrecorded line on the recording sheet in a manner to face the thermal head 1 in readiness for a subsequent recording.

A thermal head according to the second embodiment of the present invention will be explained below.

Figure 2A:
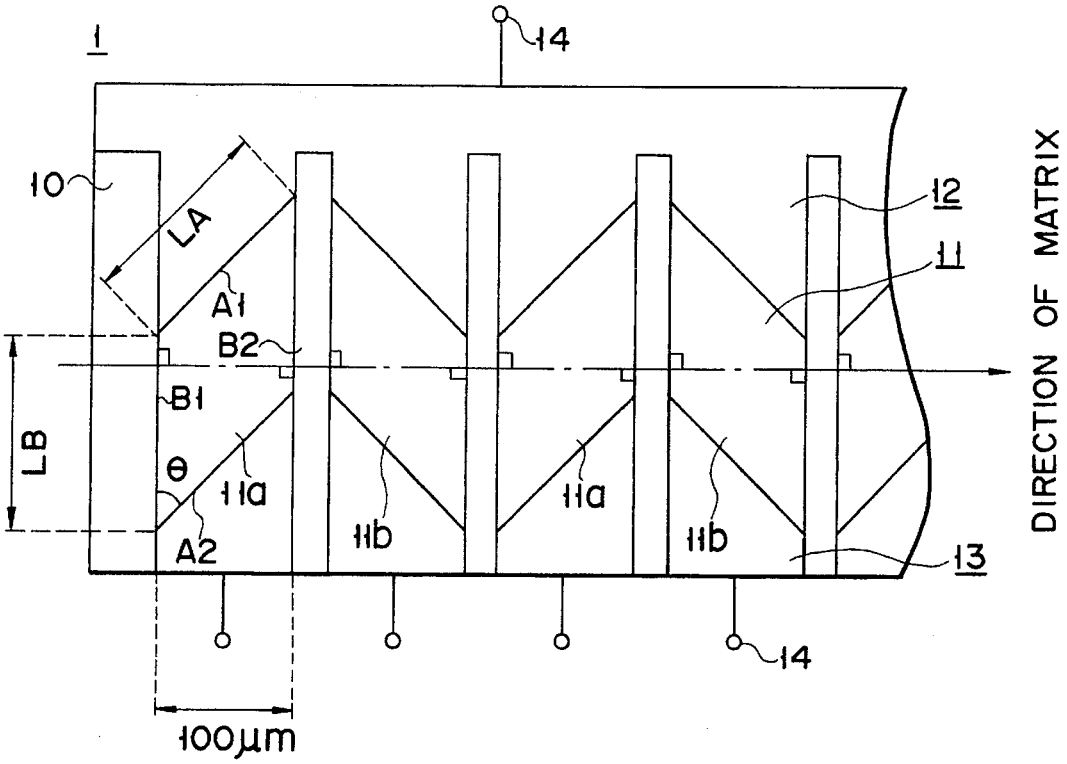
FIG. 2A is a plan view showing an arrangement of a thermal head according to a second embodiment of the present invention.

FIG. 2A is a plan view showing an arrangement of the thermal head of the second embodiment. Identical reference numerals are employed to designate parts and elements corresponding to those shown in the preceding embodiment.

The feature of the second embodiment lies in that, in the thermal head of the second embodiment, adjacent heat generation resistors 11 are alternately reversed in a mirror image relation to each other, that is, those resistors 11*a* are arranged in the same way as in the thermal head as shown in FIG. 1A with those resistors 11*b* reversed in a line-symmetrical relation to the resistors 11*a* as shown in FIG. 1A.

Figure 2B:
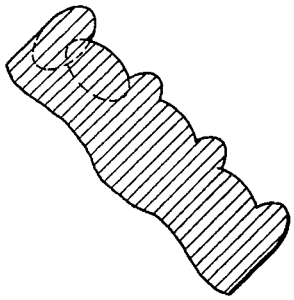
FIG. 2B is a view showing another form of recording pattern (diagonal line) as made by a thermal head according to a second embodiment of the present invention.

In the present thermal head, elliptic dots recorded by the resistors 11*a* have their major-axes oriented in a direction substantially perpendicular to those recorded by the resistors 11*b*. Upon the recording of diagonal-line elements of an image as dots by the present thermal head, the diagonal-line elements appear as a less-jagged line as shown in FIG. 2B.

According to the present embodiment as set out above, since the resistors 11 are arranged in a direction perpendicular to the opposite sides B1 and B2 not connected to the lead electrodes 12 and 13, they can ensure a higher level than that, as achieved by the conventional counterpart, even if being optimally shaped under the following conditions (1) and (2).

(1) The length LA of the opposite sides A1, A2 connected to the lead electrodes 12 and 13 is set equal to the length LB of the sides B1, B2 not connected to the lead electrodes 12 and 13.

(2) An acute angle θ is set at 45° between the sides A1 and B1 and between the sides A2 and B1.

Since the adjacent resistors 11 are arranged in a mirror-image relation to each other, the corresponding adjacent elliptic dots as recorded by the adjacent resistors 11 have their major axes oriented in a direction substantially perpendicular to each other, making it possible to produce a less-jagged contour line upon the recording of a diagnol line as dots on the recording sheet. It is thus possible to achieve an improved image quality.

The present invention is not restricted to the aforementioned embodiments. Although the preceding embodiments have been explained as being applied to the facsimile equipment for which case the resolution is 8 [dots/mm] in the horizontal scanning direction, the present thermal head can be applied also to an ordinary thermal printer, and so on, for which case the resolution is not restricted to 8 [dots/mm] in the horizontal scanning direction.

Although, in the preceding embodiments, the resistors have been explained as having a ratio of the length of the opposite sides A1, A2 and length of the other opposite sides B1, B2 of 1 for the case of an acute angle θ of 45° between the corresponding sides (A1, B2 and A2, B1), the length ratio may be in a range of below 1 for which case the acute angle is below 45° .

According to the first embodiment of the present invention, a thermal head can be achieved which can make a better recording in spite of a lower image resolution because the resistors are arranged in a direction substantially perpendicular to the two opposite sides not connected to the lead electrodes.

According to the second embodiment of the present invention, a thermal head can be realized which can make a better recording, in spite of a lower image resolution, with the use of resistors of an optimal array with the adjacent two resistors oriented, in a mirror-image fashion, in a direction substantially perpendicular to those two opposite sides not connected to the lead electrodes and can also record a less-jagged diagonal line on a recording sheet in an improved image quality.

A thermal head according to a third embodiment of the present invention will be explained below in connection with a thermal printer.

Figure 1C:
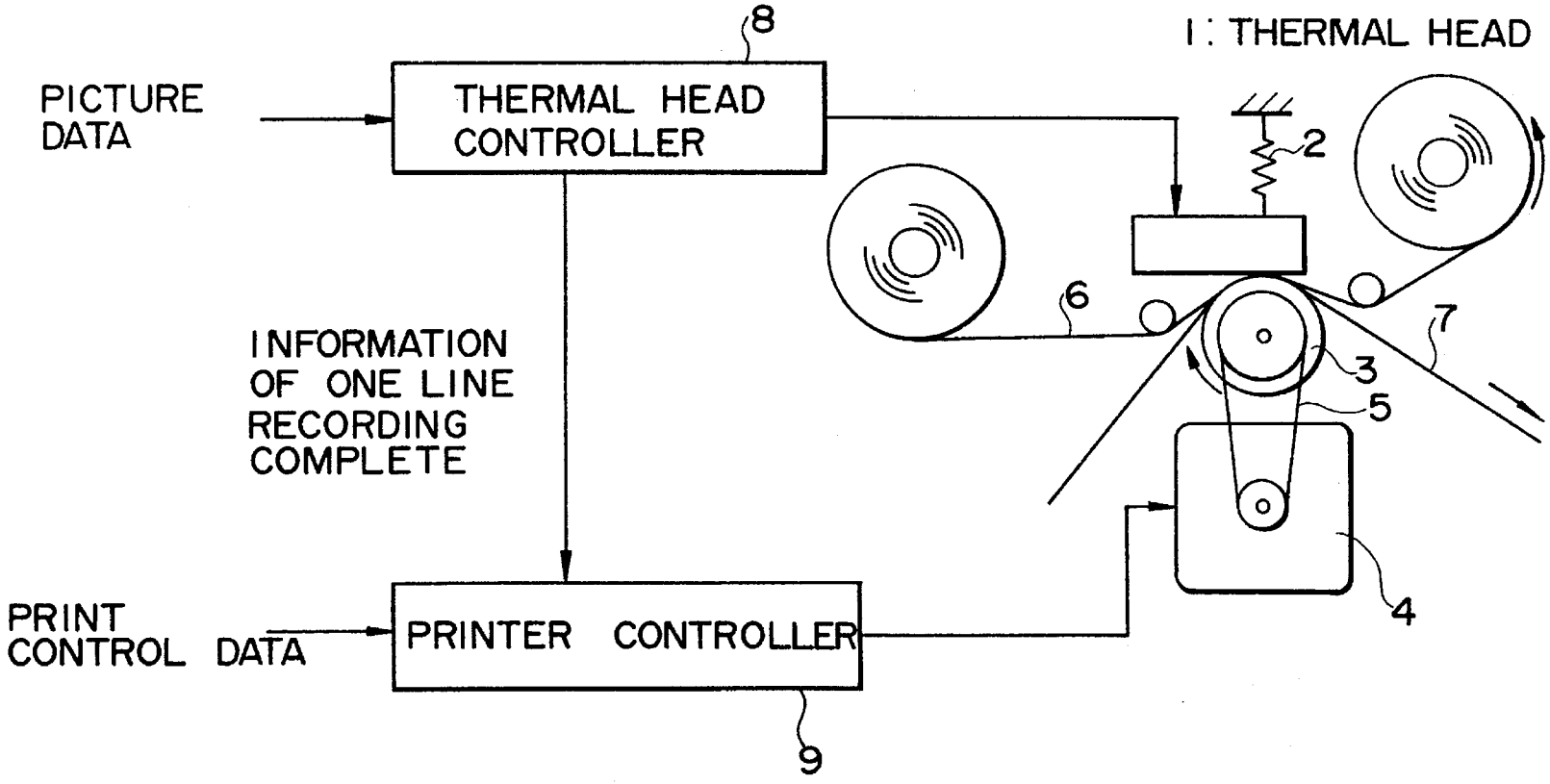
FIG. 1C is a diagrammatic view showing a thermal printer equipped with the thermal head according to the first embodiment.

The basic feature of a thermal printer according to the present invention as shown in FIG. 1C lies in that use is made of a thermal head 10 as will be set out below.

Figure 6A:
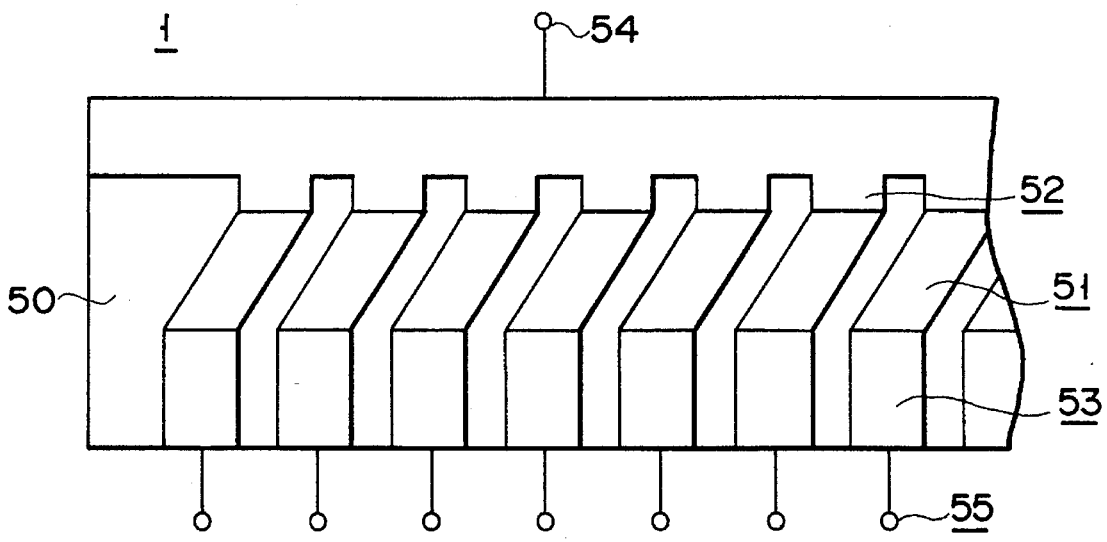
Figure 6B:
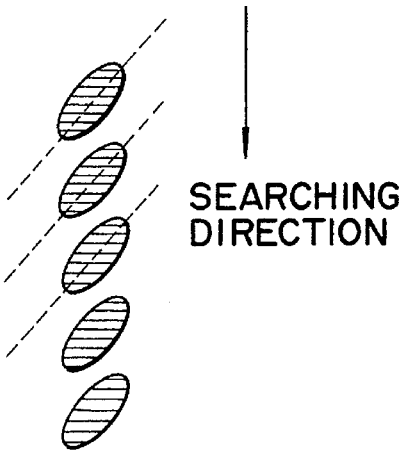
FIG. 6B shows a conventional form of recording as made by a conventional thermal head.
Figure 7:
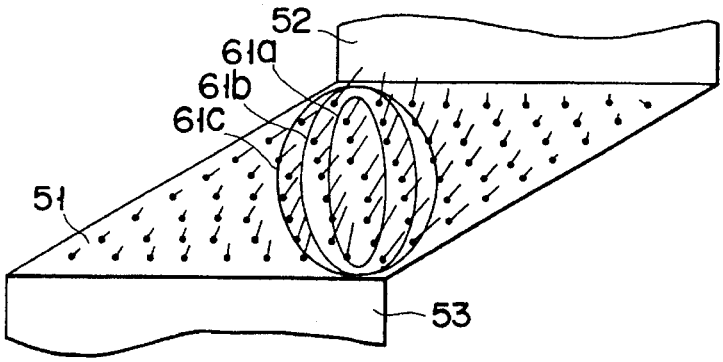
Figure 8:
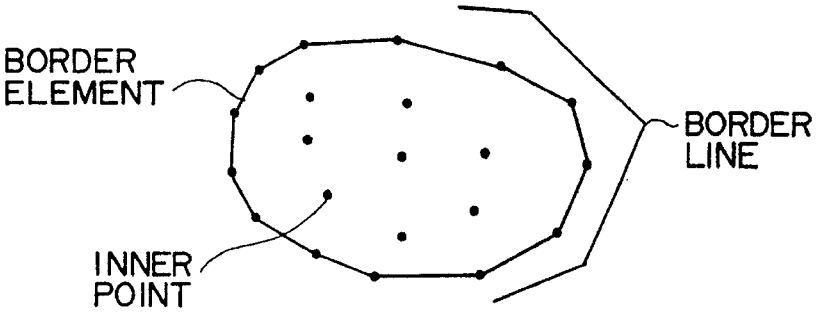
Figure 9:
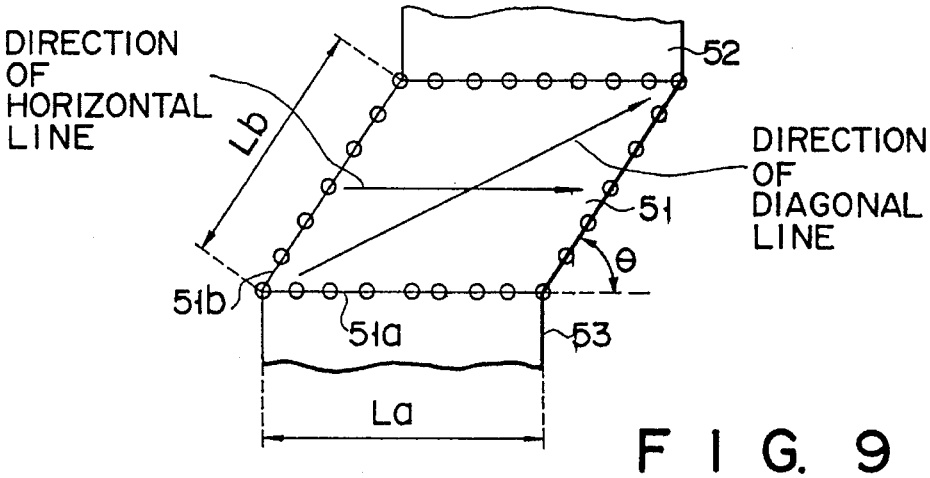

FIG. 3A is a plan view showing the thermal head 10 which has an arrangement similar to that for a conventional thermal head 1 as shown in FIG. 6A. That is, a plurality of heat generation resistors 12 of parallelogrammic shape are one-dimensionally arranged at a predetermined interval on an insulating substrate 11, such as ceramics or alumina. A common lead electrode 13 is connected to one end of the resistors 12 and lead electrodes (drive electrodes) 14 are connected to the other end of the respective resistor 12 with external terminals 15 and 16 connected to the lead electrodes 13 and 14, respectively, to provide a thermal head of an integral structure.

The respective resistor 12 has a shape as shown in FIG. 3B. Given that an obtuse angle α is defined between a resistor's side A connected to the lead electrode 14 and an adjacent one of two opposite sides B of the resistor with an intersection C defined between the adjacent sides A and B and a perpendicular D extending across the resistor from the intersection C, an imaginary line E passing through the intersection C and within an acute angle β range defined between the side B and the perpendicular D is set in a direction perpendicular to a direction in which the resistors 12 are arranged. Put in another way, vertical scanning is performed in a direction of the imaginary line E defined as a line passing through the intersection C within the angle β range.

In the resistor 12 of parallelogrammic shape, in general, a center of energy concentration is present along a line, such as the line E, passing past the junction C within a range corresponding to the acute angle β. That is, elliptic dots are recorded by the resistors 12 on a recording sheet with their major axes situated on the line passing through the junction C within the range corresponding to the acute angle β. Thus the respective elliptic dots are recorded by the thermal printer on the recording sheet in the vertical scanning direction corresponding to their major axes, as shown in FIG. 3C. As appreciated from the above, the elliptic dots have their major axes oriented in the vertical scanning direction and, with attention paid to their elliptic dots, recording can be made on the recording sheet 7 in a continuous line with the elliptic dots overlapped relative to each other.

with the major axes of the elliptic dots extending in the vertical scanning direction and the end portions of the elliptic dots overlapped in the vertical scanning direction, the edge portions of the respective dots are oriented in a vertical scanning direction in a continuous line and, upon the separation of an ink film 6 from the recording paper 7, no undue separation force is applied to an ink transferred to the recording sheet 7. It is thus possible to perform a stable transfer of ink to the recording sheet.

According to the present embodiment, the resistors 12 are so obliquely formed that the marginary line E passing through a junction C in a range corresponding to the acute angle β defined between the resistor's side B and the perpendicular D is set in a direction perpendicular to the array of the resistors 12. Since the recorded elliptic dots have their major axes oriented in the vertical scanning direction, the greater portion of the edges of the recorded dots is present in the vertical scanning direction so that a smaller angle is provided in a direction in which the ink film 6 is separated from the recording sheet 7. Upon the separation of the ink film 6 from the recording sheet 7, stabler ink transfer is performed without involving any unsteady separation. According to the present invention, a thermal recording apparatus, such as a thermal printer, is equipped with a thermal head capable of making an image recording without degenerating an image quality.

According to the third embodiment, the resistors in the thermal head are obliquely so arranged at a predetermined angle that, within an acute angle range defined between a perpendicular, on one hand, drawn from the apex of one of opposite obtuse angles of the parallelogram of the respective resistor toward the resistor's side connected to the lead electrode and an adjacent one, on the other hand, of those opposite sides not connected to the lead electrodes, a line passing through the aforementioned apex extends in a direction orthogonal to a direction (horizontal scanning direction) in which the resistors are arranged. It is, therefore, possible to provide a thermal recording apparatus which can perform a stable ink transfer operation upon the separation of an ink film from the recording sheet and can record a high-quality image on a recording sheet.

A thermal head according to another embodiment of the present invention will be explained below in conjunction with a color printer using it.

Figure 4A:
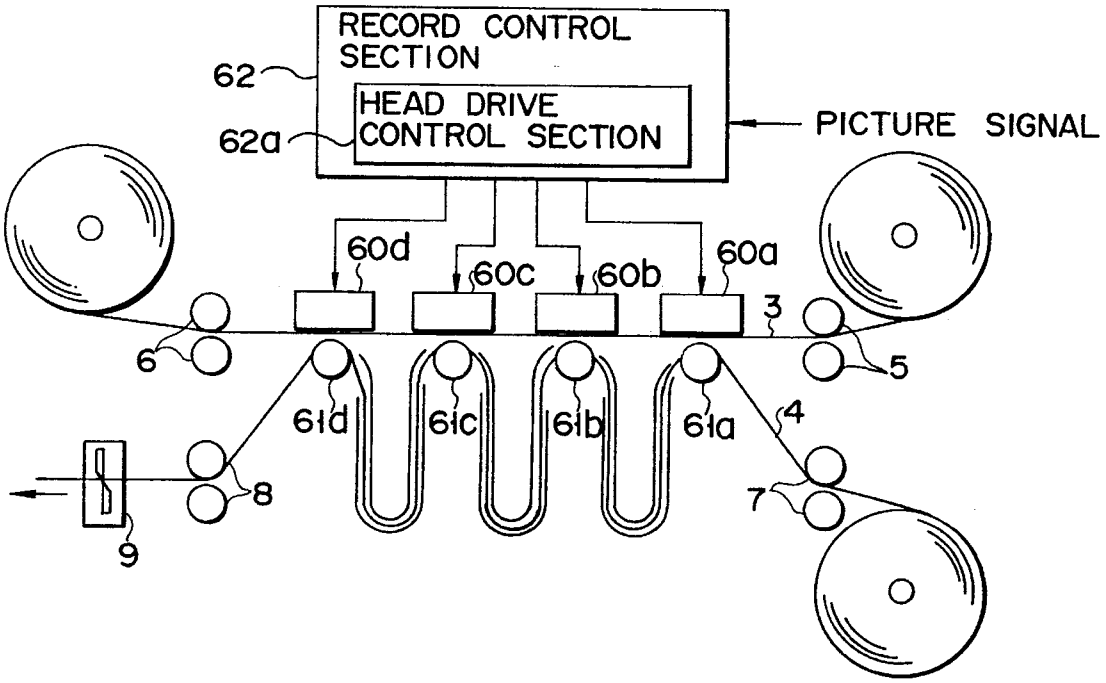
FIGS. 4A and 4B are views for explaining a color recording apparatus according to other embodiments of the present invention, FIG. 4A showing an arrangement of the present color recording apparatus and FIG. 4B showing forms of thermal head section in FIG. 4A.

FIG. 4A is a diagrammatic view showing an arrangement of a color printer according to another embodiment of the present invention. In FIG. 4A, a line type of thermal heads 60*a*, 60*b*, 60*c* and 60*d* is arranged in their recording positions in a manner to face platen rollers 61*a*, 61*b*, 61*c* and 61*d*, respectively. An ink film (ink ribbon) 3 and recording sheet 4 are fed past the thermal head (60*a*, . . . , 60*d*) and platen roller (61*a*, . . . , 61*d*) in pair.

A record control section 62 for coordinately controlling a recording operation of a present color printer includes, in addition to a known ordinary control circuit for, for example, controlling a feed control of the ink ribbon 3 and recording sheet 4 and other operations, a head drive control section and controllably drives the thermal heads 60*a*, . . . , 60*d*.

The thermal heads 60*a* and 60*d* are structurally different from the thermal head of the respective preceding embodiments in the following respects.

Figure 4B:
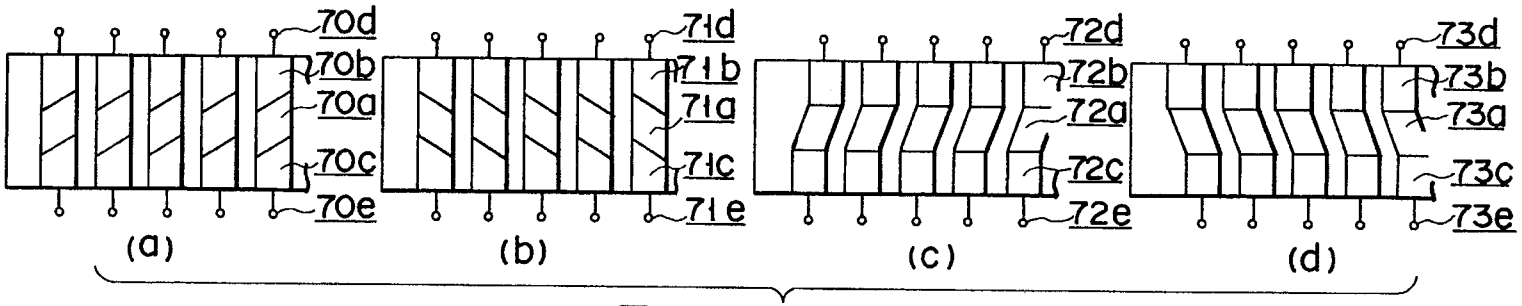

FIGS. 4B(*a*), . . . , (*d*) show arrangements of thermal heads 60*a*, . . . , 60*d*, respectively, applicable to the present color printer, the thermal head 60 *a* including resistors 70*a* arranged at a predetermined interval with both ends connected to corresponding lead electrodes 70*b* and 70*c*, . . . , and the thermal head 60*d* including resistors 73*a* arranged at a predetermined interval with both ends connected to corresponding lead electrodes 73*b* and 73*c*. That is, the thermal heads 60 *a*, . . . , 60*d* are so constructed that their corresponding resistors 70*a*, . . . , 73*a* are arranged at the predetermined interval with both ends overlappingly connected to the corresponding lead electrodes 70*b*, . . . , 70*c* and 71*c*, . . . , 73*c*, respectively, and that the lead electrodes 70*b*, . . . , 73*b* and 70*c*, . . . , 73*c* are connected to external terminals 70*d*, . . . , 73*d* and 70*e*, . . . , 73*e*, respectively. These thermal heads are substantially similar to an ordinary (conventional) thermal head except for the following points. According to the present thermal heads 60 *a*, . . . , 60*d*, the resistors 70*a*, . . . , 73*a* have a parallelogrammic shape, as shown in FIG. 4B, which includes oblique opposite sides with their oblique angle defined relative to a horizontal scanning direction.

The operation of the color printer will be explained below in conjunction with its associated thermal head of the present embodiment.

The record control section 62 receives an image signal and converts it to color record signals of yellow, magenta, cyan and black. The recording control section 62 drives the thermal heads 60 *a*, . . . , 60*d*, by the head drive control section 62*a*, based on the color record signals of yellow, magenta, cyan and black, respectively. Stated in more detail, at the start of recording, the leading edge portion of a yellow area of an ink ribbon 3 and that of a recording sheet are located, in a registering relation, relative to a recording position of the thermal head 60 *a* and, in this state, recording is made, by the thermal head 60 *a* , for yellow color. Then the recording sheet 4 makes a detour to a recording position of the thermal head 60*b* as shown in FIG. 4A. A leading portion of a magenta area of the ink ribbon 3 and that of the recording sheet 4 are similarly located relative to the recording position of the thermal head 60*b* and, in this way, recording is made, by the corresponding thermal head, on the recording sheet in the order of the colors yellow, magenta, cyan and black as will be readily understood from FIG. 4A. Thus, the head drive control section 62*a* controls the drive timing of the thermal heads 60*b*, 60*c* and 60*d* such that they are stepwise delayed in the order of the thermal heads 60*b*→60*c*→60*d* starting with the driving point of the thermal head 60 *a*. Recording is made on the recording sheet with a time at which the leading edge portion of the recording sheet is moved to the recording position of the respective thermal heads 60*b*, 60*c* and 60*d*. By so doing, color dots are recorded on the recording sheet exactly in the same position.

Let it be assumed that, in a thermal head, heat generation resistors are parallelogrammic in shape. In this case it has been known that there occurs a concentration of energy in terms of an energy distribution in the resistors to produce elongated dots, such as elliptic dots. The major axes of the elliptic dots are differently oriented depending upon the obliqueness of the parallelogramic resistor, the obliqueness of the resistor relative to a horizontal scanning direction and so on. Thus the elliptic dots as recorded by the thermal heads 60 *a*, . . . , 60*d* have their major axes oriented differently in their individual directions.

Figure 5A:
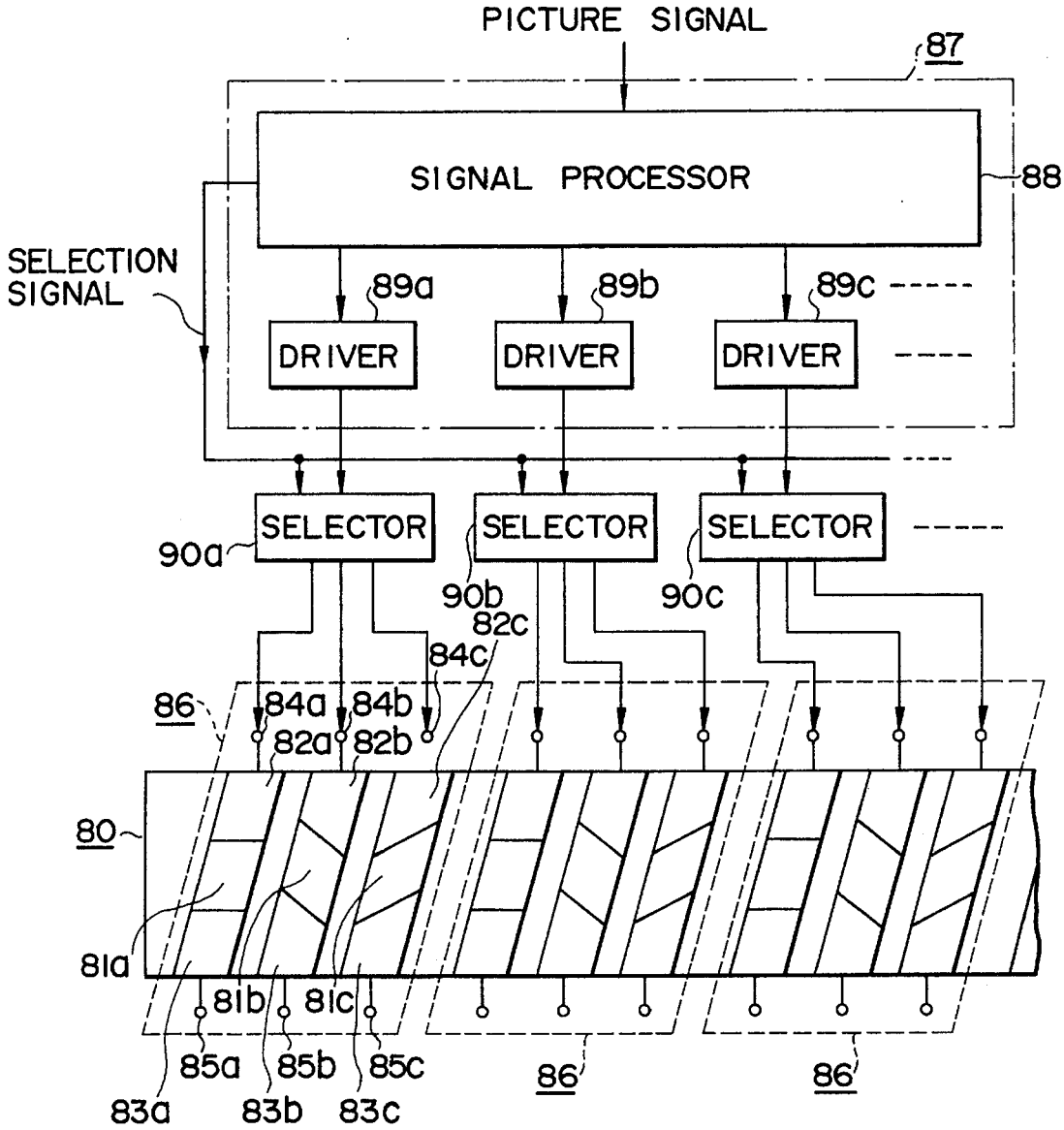
FIG. 5A is a view for explaining a color recording apparatus according to another embodiment of the prevent invention.
Figure 5B:
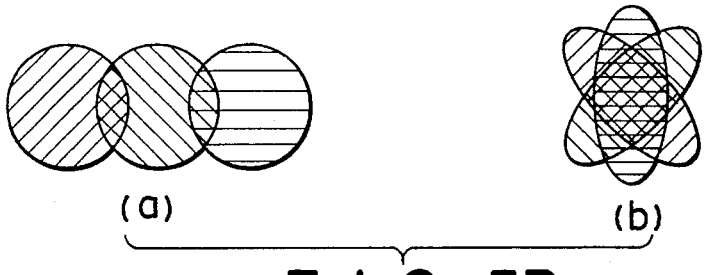
FIG. 5B is a view for explaining a color recording method of the present invention.

In this case, the color printer prints the color dots yellow, magenta, cyan and black by the thermal heads 60 *a*, 60*b*, 60*c* and 60*d*, respectively, and, since the color dots are printed as elliptic dots whose major axes are oriented differently in their individual directions, a resultant pixel is recorded in a pattern as shown, for example, in FIG. 5B(*b*).

According to the present embodiment, the resistors are parallelogrammic in their shape and the four thermal heads 60 *a*, 60*b*, 60*c* and 60*d* are all of such a type that the paralleograms of their resistors are made oblique in their shape and oblique relative to the horizontal scanning direction. Since any of the four thermal heads 60 *a*, . . . , 60*d* is/are selected in accordance with color with which the dot is recorded, the recorded elliptic dots have their major axes differently oriented in their individual directions in different colors to obtain a pixel as shown in FIG. 5B(*b*). By so doing, the respective color dots of which one pixel consists are, while being mutually displaced in their major axes, occupied on the same location, preventing the generation of a "moiré".

In the preceding embodiments, since the respective dots are recorded, while being displaced relative to each other, on the recording sheet in a continuous line, if recording is made at a high resolution level, an interference may occur between mutually adjacent pixels.

According to this embodiment as opposed to the preceding embodiments, however, it is possible to properly record dots at a high resolution level because they are recorded in the same position. It is also possible to control recording dots in varying size with the use of a specific parallelogram of the heat generation resistors 70*a*, . . . , 73*a* in the thermal heads 60 *a*, . . . , 60*d* and hence to record dots in more color tones. Further, it is only necessary to perform one recording process, without need to withdraw the recording sheet 4, so that the recording speed can be quickened.

Although, in the aforementioned embodiment, the resistors 70*a*, . . . , 73*a* have been explained as being parallelogrammic in their shape, they may take any proper shape so long as dots can be recorded as elongated ones.

FIG. 5A shows a major section of a color printer using a thermal head according to another embodiment of the present invention.

The present color printer is similar to a conventional printer in their basic hardware structure, but the associated thermal head, in particular, has a structure as will be set out above. A thermal head 80 in FIG. 5A includes a plurality of heat generation element groups 86 one-dimensionally arranged at a predetermined interval. The respective heat generation element 86 is of such a type that three heat generation resistors 81*a*, 81*b* and 81*c* are arranged at a predetermined interval in a parallel fashion with lead electrodes 82*a*, 82*b*, 82*c* and 83*a*, 83*b*, 83*c* overlappingly connected to both ends of the resistors 81*a*, 81*b*, 81*c* and external terminals (84*a*, 84*b*, 84*c*) and (85*a*, 85*b*, 85*c*) connected to the lead electrodes (82*a*, 82*b*, 82*c*) and (83*a*, 83*b*, 83*c*), respectively. The width of the element group 86 is so formed as to be made somewhat narrower than one pixel width (about 125 μm if recording is made, for example, at 8 dots/mm). That is, the thermal head 80 makes recording, for one pixel, by resistors 81*a*, . . . , 81*c* of which the element group 86 consists. The three resistors 81*a*, . . . , of which the element group 86 consists are parallelogrammic in shape and the parallelograms of the resistors are made oblique in their opposite sides and oblique relative to the horizontal scanning direction.

A record control section 87 includes a signal processor 88 and drivers 89*a*, 89*b*, 89*c*, . . . . The signal processor 88 converts a received input image signal, by a known processing for example, to record signals for respective colors and to control signals for the thermal head 80. The signals processed by the signal processor 88 are delivered to drivers 89*a*, 89*b*, 89*c*, . . . . The drivers 89*a*, 89*b*, 89*c*, . . . , supply drive currents to the corresponding resistors in the thermal head 80. The drive currents of the drivers 89*a*, 89*b*, 89*c*, . . . are supplies to selectors 90*a*, 90*b*, 90*c*, . . . as heat generation element select means. The selectors 90*a*, 90*b*, 90*c*, . . . receive select signals from the signal processor 88 and supply the drive current to either one of the resistors 81*a*, . . . , 81*c* in the heat generation element group 86 in accordance with the select signal.

The operation of the present color printer will be explained below.

As in the same way as set out above in connection with the conventional color printer, the signal processor 88 converts a received image signal to the color recording signals, yellow, magenta, cyan and black. These color recording signals are sequentially supplied to the drivers 89*a*, 89*b*, 89*c*, . . . to enable the thermal head 80 to sequentially record color data on a recording sheet. However, the selectors 90*a*, 90*b*, 90*c*, receive specific color information of recording signals being output from the signal processor, that is, color information to be currently recorded, as select signals from the processor 88 and drive currents of the drivers 89*a*, 89*b*, 89*c*, . . . are supplied to either one of the resistors 81*a*, . . . , 81*c* in the heat generation element group 86 in accordance with the select signal. That is, the selectors 90*a*, 90*b*, 90*c*, . . . select, for example, the resistor 81*a* when a recording signal being output from the signal processor 88 represents the color yellow, the resistor 81*b* when a recording signal represents the color magenta and the resistor 81*c* when a recording signal represents the color cyan. Regarding the color black, one of three resistors 81*a*, . . . , 81*c* in the heat generation element group 86 may be utilized since the color black is not mixed with the other colors.

In this way, the three heat generation resistors 81*a*, . . . , 81*c* in the element group 86 are selectively utilized in accordance with the color to be recorded on the recording sheet. Here, as set out above, recorded elongated dots have their major axes differently oriented in accordance with the obliqueness of the parallelogrammic resistor and that of the resistor's sides relative to a horizontal scanning direction. Therefore, the elongated dots have their major axes differently oriented in accordance with the resistors 81*a*, . . . , 81*c*

.

Since, according to the present embodiment, the major axes of the elongated recorded dots are differently oriented in accordance with the colors, it is possible to prevent the generation of a moiré (interference).

Although, in the aforementioned embodiment, the heat generation resistors 81*a*, . . . , 81*c* have been explained as being parallelogrammic in shape, any proper shape may be employed so long as recorded dots have an elongated shape.

Although, in the respective embodiments, the color printer has been explained as using the colors yellow, magenta, cyan and black by way of example, it may be possible to use other colors or the aforementioned colors plus other colors. In the aforementioned embodiments, the respective color dots are either all displaced in their recording positions or have their major axes differently oriented in their directions, but at least one dot may be displayed relative to the other dots in their recording position or may be recorded as elongated dots with their major axes differently oriented. Although, in the aforementioned embodiment, non-partially-overlapped areas are provided among the dots by displacing the recording positions of the dots relative to each other or having the major axes of the elongated dots differently oriented in their directions, it may be possible to change the shapes of the dots as a combination of different shapes, including elliptic, rectangular and other elongated shapes, in accordance with color.

Since, in the present embodiments, at least one of varied color dots is made to have an overlapped portion relative to other color dots by, for example, displacing their recording positions as shown in FIG. 5B(*a*) or having the major axes of elongated dots differently oriented in their directions as shown in FIG. 5B, any moiré (interference) is prevented from being generated, thus ensuring a high-quality image and hence achieving a color recording apparatus having a thermal head capable of making an effective recording and, in particular, a color recording.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A thermal head for a thermal recording apparatus, comprising:

means for recording a continuous line of elliptic dots on a recording sheet, said means including a plurality of heat generation resistors arranged one-dimensionally along a given direction, each of the heat generation resistors formed to have a parallelogram shape including four sides and two diagonal lines and configured such that the four sides of the parallelogram shape have directions crossing the given direction and such that two diagonal lines extending between opposing corners of the parallelogram shape have directions crossing the given direction; and a plurality of drive electrodes respectively connected to said heat generation resistors;

wherein an ink film and the recording sheet for thermal recording, which are stacked on one another, are brought into contact with said heat generation resistors and moved in a direction orthogonal to the given direction along which said heat generation resistors are arranged and, during this movement, ink coated on the ink film is melted by said heat generation resistors to allow an image to be transferred to the recording sheet.

2. The thermal head according to claim 1, wherein said heat generation resistors in the thermal head are arranged such that a line passing through an apex of one of opposite obtuse angles defining a pair of the opposing corners of the parallelogram shape of each of the heat generation resistor extends orthogonal to the given direction of arrangement of said heat generation resistors within an acute angle range defined between a line perpendicular to one of the four sides to which one lead electrode is connected, drawn from said apex toward an opposite one of the four sides of said parallelogram shade to which another lead electrode is connected, and another one of the four sides of said parallelogram shape which extends from said apex and to which no lead electrode is connected.

3. The thermal transfer head according to claim 1, wherein said plurality of heat generation resistors are arranged one-dimensionally along the given direction with spaces therebetween and said plurality of drive electrodes are arranged one-dimensionally along the given direction and respectively connected to respective first sides of the parallelogram shape of the heat generation resistors, second sides facing the respective first sides of the heat generation resistors being connected to a common electrode.

4. The thermal transfer head according to claim 1, wherein each of said plurality of heat generation resistors is configured such that an imaginary line perpendicular to the given direction passes through one of four corners of the parallelogram shape and one of the four sides of the parallelogram shape.

* * * * *

UNITED STATES PATENT AND TRADEMARK OFFICE

CERTIFICATE OF CORRECTION

PATENT NO. : 5,483,274

DATED : January 09, 1996

INVENTOR(S) : Nobuhiro Inoue et al

It is certified that error appears in the above-indentified patent and that said Letters Patent is hereby corrected as shown below:

Claim 2, Column 16, Line 1, "shade" should read --shape--;

Claim 3, Column 16, Lines 8 and 9, "ther-ebetween" should read --there-between--.

Signed and Sealed this

Twenty-ninth Day of October 1996

*Attest:*

BRUCE LEHMAN

*Attesting Officer*

*Commissioner of Patents and Trademarks*